US005328265A

United States Patent [19]

Clooney

[11] Patent Number: 5,328,265

[45] Date of Patent: Jul. 12, 1994

[54] COMBINATION BAG AND NAPKIN

[76] Inventor: Nina Clooney, 230 E. Broadway, #505, Salt Lake City, Utah 84111

[21] Appl. No.: 961,151

[22] Filed: Oct. 15, 1992

[51] Int. Cl.[5] ..... B65D 30/20

[52] U.S. Cl. ..... 383/4; 383/122; 383/902

[58] Field of Search ..... 383/4, 120, 122, 902; 229/186

[56] References Cited

U.S. PATENT DOCUMENTS

| | | | |
|---|---|---|---|
| 1,342,432 | 6/1920 | Eaton | 383/120 X |
| 1,351,412 | 8/1920 | Carr | 383/122 X |
| 1,359,856 | 11/1920 | Anderson | 383/122 X |
| 1,385,831 | 7/1921 | Hulbert | 383/120 X |
| 2,050,549 | 4/1935 | Wilmer | 130/1 |
| 2,104,686 | 1/1938 | Wood | 383/120 X |
| 2,690,199 | 9/1954 | Bennorth | 383/122 X |
| 2,831,624 | 3/1954 | Lever | 229/52 |
| 2,855,768 | 12/1958 | Barnes et al. | 383/122 X |
| 3,202,193 | 2/1963 | Ware | 150/52 |
| 3,714,669 | 2/1971 | Vorbau | 2/46 |
| 3,764,061 | 10/1973 | Hulbert | 229/70 |
| 4,484,350 | 11/1984 | Gordon | 383/4 |
| 4,618,992 | 10/1986 | LaGrotteria | 383/4 |
| 4,887,315 | 12/1989 | Bezdek | 2/49 |
| 4,941,756 | 7/1990 | Price | 383/127 |
| 4,952,073 | 8/1990 | Wieland | 383/4 |
| 4,974,966 | 12/1990 | Fabbi | 383/122 X |
| 4,985,932 | 1/1991 | Bezdek | 2/49 A |
| 5,056,159 | 10/1991 | Zemke, Jr. | 2/49 A |

FOREIGN PATENT DOCUMENTS

| | | | |
|---|---|---|---|
| 91438 | 11/1921 | Switzerland | 383/4 |

*Primary Examiner*—Allan N. Shoap
*Assistant Examiner*—Christopher McDonald
*Attorney, Agent, or Firm*—Wood, Herron & Evans

[57] ABSTRACT

A combination bag and napkin suitable for carrying meals and food items and convertible to a napkin for use while eating. The invention includes a pressure sensitive non-drying adhesive section which allows the napkin to be temporarily attached to one's clothing or dining surface while eating. The invention also uses the pressure sensitive non-drying adhesive to maintain the bag configuration. The bag converts to a napkin without the need for perforations or tear lines by detaching the adhesive and unfolding the bag. A specific fold pattern allows the napkin to be formed into a bag without wasted material or tearing of the bag.

16 Claims, 4 Drawing Sheets

COMBINATION BAG AND NAPKIN

BACKGROUND OF THE INVENTION

This invention relates to food carrying bags. More particularly, the invention relates to paper bags which are used for carrying meals or food items and the need for a napkin while consuming the food.

Paper bags customarily have been constructed of a single sheet of paper which is folded to form an elongated rectangular bag. The seams are glued to form the bag's bottom and one of the faces of the bag. Paper bags of this type include folds and pleats which allow the empty bag to collapse flat for storage. When the bag is being filled, the folds allow the bag to stand upright on its bottom for easy access to the open top end of the bag. Bags of this type are commonly used in the fast food industry for take out or carry out food orders. In addition, so called "brown bag" lunch sacks use this type of construction.

With a bag of the type described, a napkin is often not included when the bag is filled. Furthermore, when a bag of this type is to be used the meal will frequently be eaten at an inconvenient location. Many take out orders are eaten while simultaneously driving or riding in an automobile and common paper napkins are too small to protect one's clothing. Similarly, many "brown bag" lunches are consumed out of doors away from the amenities of the restaurant or dining room. Therefore, one is forced to consume the meal without the benefit of a napkin, oftentimes resulting in a very messy drip or stain on one's clothing or car upholstery. Likewise, without the benefit of a napkin, one is unable to wipe their face and hands after or during the meal.

Furthermore, even if a napkin is included in the bag, the napkin is inadequate to protect one while eating. The napkin is either too small or not adapted to protecting one's clothing. Nevertheless, the diner tries to awkwardly stuff and tuck a napkin in a shirt or collar for protection from messy drips. Alternatively, paper bags known in the art are emptied and cumbersomely torn and ripped apart in an attempt to adapt it for use as a napkin, bib, or place mat. Even if known paper bags can be torn and adapted for such a use, the diner can no longer use the bag for a ready trash receptacle once the meal is finished.

SUMMARY OF THE INVENTION

It has been an objective of the present invention to provide a paper bag which can be conveniently converted to a functional napkin for use while dining. Another objective of the invention is to provide a bag which can be used to transport food items and upon being emptied be easily converted to a readily usable protective covering for one's clothing and then re, converted to a bag once the meal is finished to collect the refuse.

These objectives of the invention are obtained by a combination bag and napkin. The paper bag is formed from flat sheets of paper or other foldable material suitable for a napkin. The bag is formed from the flat sheet as a result of a specific pattern of fold and pleat lines on the sheet. The resulting bag is of generally the same configuration as the bag currently used in the food service and lunch bag industries. The bag has an elongated rectangular shape with a flat bottom and opened top through which the food is inserted. When empty and not in use, the bag can also collapse flat for convenient storage.

In one preferred embodiment, the bag according to the present invention has a multi-ply front and back face and single ply sides and bottom. Pressure sensitive, non-drying adhesive of the type commonly used on paper message pads may be used along the edges of the bag to join the face and sides of the bag. In this way, once the food items are removed from the bag, the bag can be converted into a napkin by separating the bag along the adhesive edges, thereby converting the bag to its flat configuration such that it may be used as a napkin. Depending upon its condition, the bag can be reformed to collect the trash for convenient waste disposal.

Uniquely, once the bag is converted to the napkin configuration, it can be secured in place as a protective cover in a bib or place mat fashion. This can be done by removing a protective tape strip covering a pressure sensitive non-drying adhesive strip on one edge of the bag. This napkin adhesive is located at the top edge of the face of the bag and once exposed can be used to secure the napkin to one's clothing for protection while eating. Alternatively, the napkin could be secured as a place mat for use while eating once the adhesive is exposed.

A second embodiment of a bag according to the present invention has single ply faces and sides. The bag is formed by using the pressure sensitive non-drying adhesive to form the bottom and joint a split on one face of the bag. A napkin according to this embodiment is generally rectangular with a napkin adhesive.

To summarize, when the sheet is folded and secured in the bag configuration using the non-drying pressure sensitive adhesive it can be used for fast food and carry out meals. Once the bag is emptied, it can be converted to a napkin and secured to one's clothing or eating area to protect from spills or drips.

BRIEF DESCRIPTION OF THE DRAWINGS

The objectives and features of the invention will become more readily apparent in the following detailed description taken in conjunction with accompanying drawings in which.

DETAILED DESCRIPTION OF THE INVENTION

Figure 1:
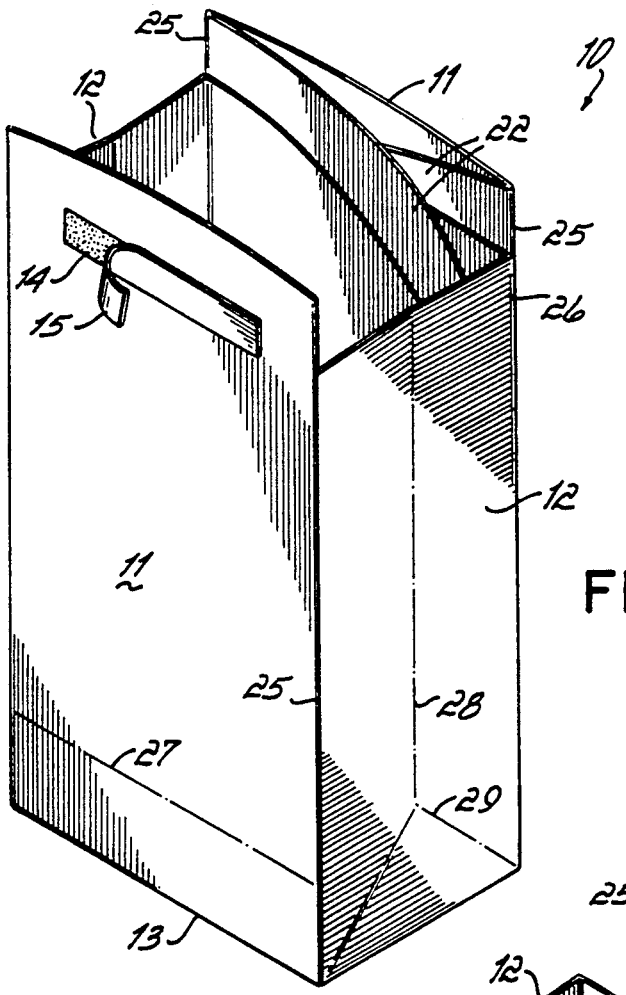
FIG. 1 is a perspective view of a first embodiment of a bag, embodying the present invention.
Figure 2:
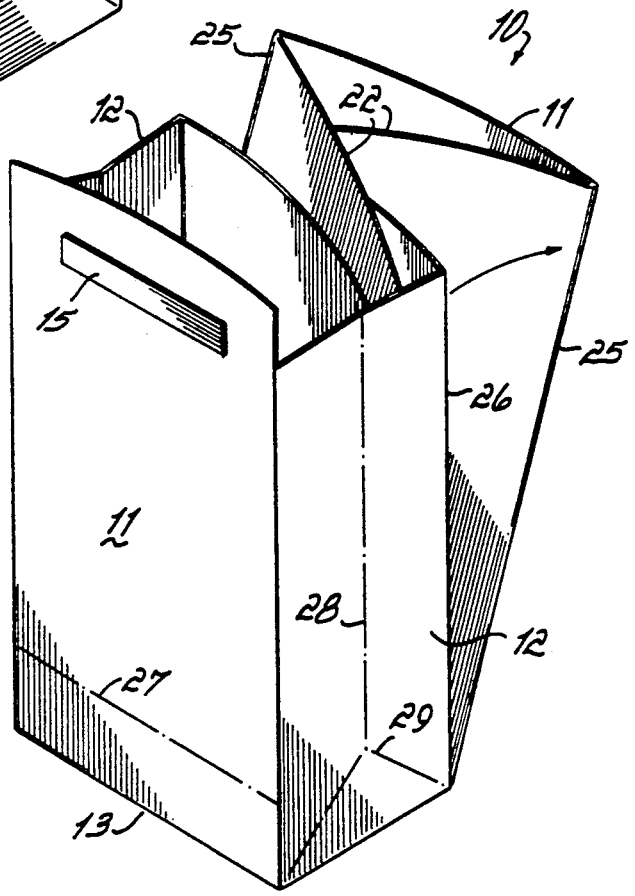
FIGS. 2, 3, and 4 are sequential perspective views of the bag of FIG. 1 illustrating the bag being converted into the napkin configuration.
Figure 3:
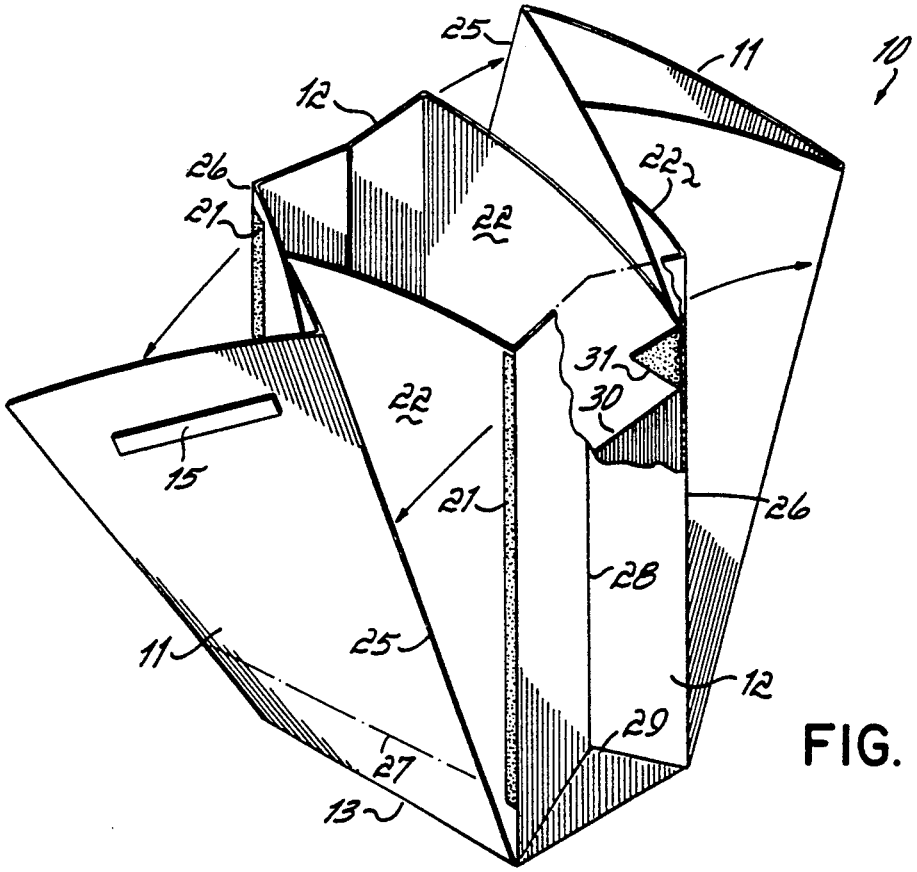
Figure 4:
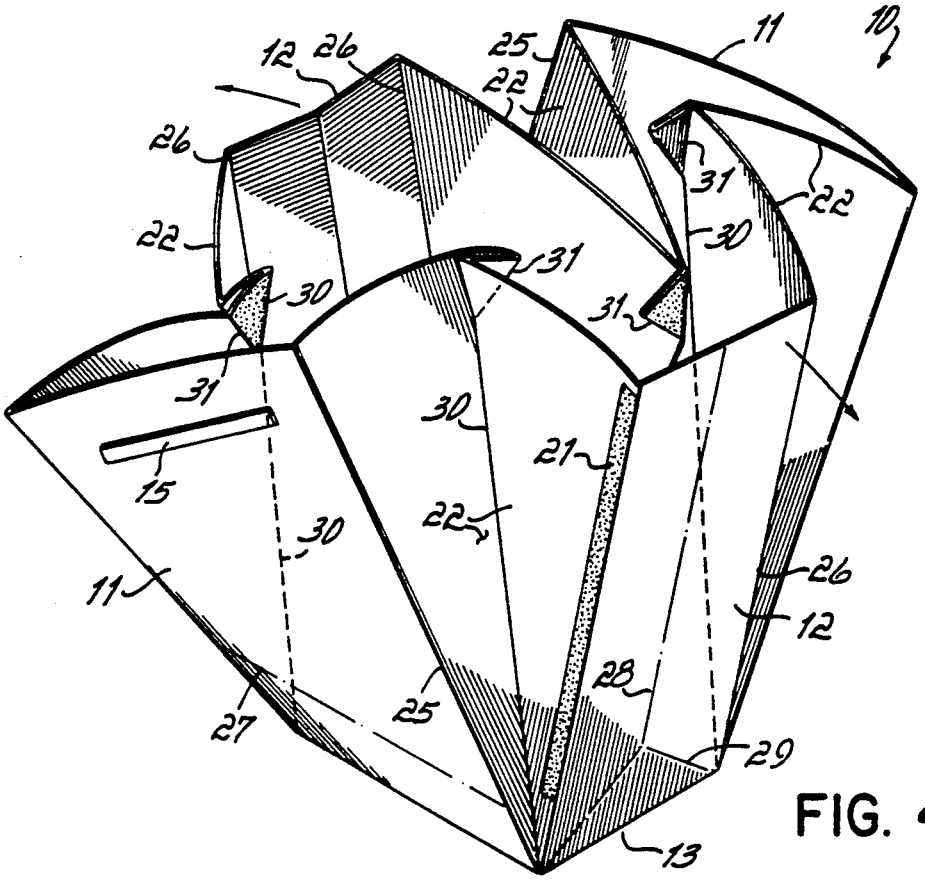
Figure 5:
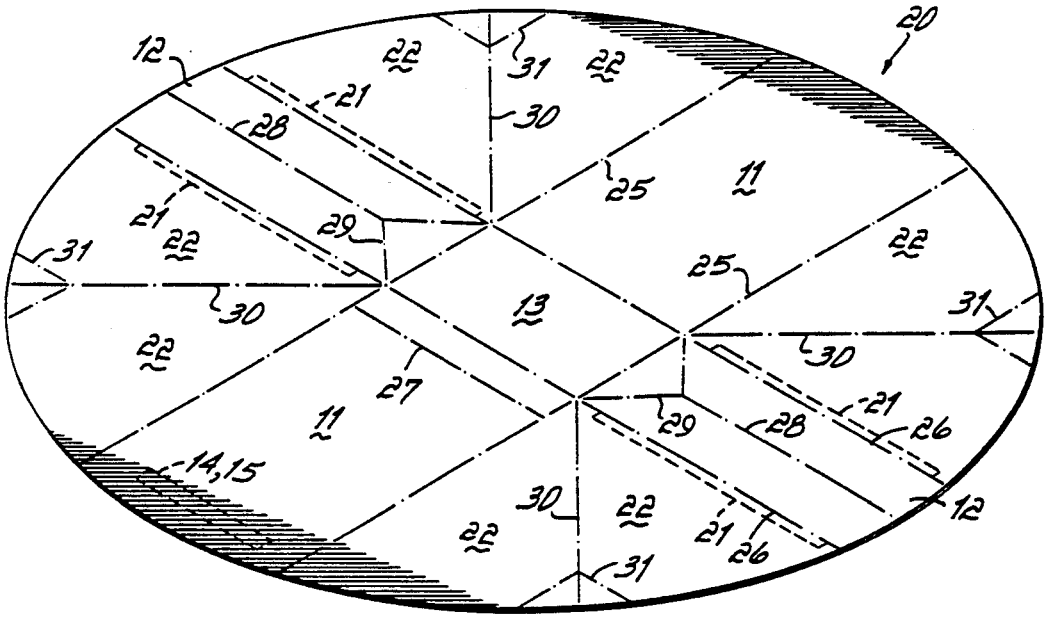
FIG. 5 is a perspective view of the unfolded bag in a flat napkin configuration illustrating the bag fold lines present in the unfolded bag of FIG. 1.

One preferred embodiment of a bag 10 according to the present invention is shown in FIGS. 1–5. This bag 10 includes a pair of faces 11, a pair of sides 12, and a bottom 13. In this configuration, food items (not shown)

can easily be placed into the bag 10 through the opened top. Also shown in FIG. 1 is a napkin adhesive 14 partially exposed from underneath a protective cover 15. In normal use, the protective cover 15 would remain attached to the napkin adhesive 14 until the user wishes to partake of the contents of the bag 10. At that point, the food items are removed from the bag 10 which is then converted into a generally circular flat napkin 20 as shown in FIG. 5. The sequential conversion of the bag into the napkin 10 configuration 20 is shown in FIGS. 2 through 4. Bag adhesive strips 21 border the outer edge of each side 12 of the bag 10. The sides 12 are separated from each face 11 along the bag adhesive strips 21 permitting each face 11 and associated flaps 22 to be unfolded. Each face 11 is unfolded in an identical manner.

As the faces 11 are unfolded, the sides 12 will likewise unfurl as shown in FIG. 4. Once the bag 10 is completely unfolded, it can be used as a napkin 20. The protective cover 15 can be removed thereby exposing the napkin adhesive 14 which is used to temporarily attach the napkin to one's clothing for use while dining. The napkin adhesive 14 could alternatively be used to secure the napkin 20 to a table (not shown) for use as a place mat.

FIG. 5 readily shows the fold lines which are used for the combination bag and napkin according to the present invention. A pair of parallel face folds 25 define the edges of the bag's two faces 11 and two of the edges of the bag's bottom 13. Perpendicular to the face folds 25 are a pair of side folds 26. Bordering the side folds 26 are the bag adhesive strips 21. The side folds 26 provide the remaining two edges of the bottom 13. Also perpendicular to and extending between the face folds 25 is a bottom flap fold 27.

Bisecting each side 12 is a pleat 28 which transitions into a triangular pleat 29 near the center of the napkin 20 and toward the bag's bottom 13. The pleat 28, triangular pleat 29, and bottom flap fold 27 all cooperate enabling the empty bag 10 to be collapsed flat when not in use.

A flap fold 30 extend from each intersection of the face folds 25 and side folds 26 to the periphery of the napkin 20. The flap folds 30 permit these portions of the napkin 20 to be folded behind each face 11 of the bag 10, as shown in FIGS. 1 through 4. Tuck fold lines 31, FIG. 5, are located on each flap fold 30 near the periphery of the napkin 20. The tuck folds 31 allow this portion of the napkin 20 to be neatly tucked within the folds when the bag 10 is formed as seen in FIGS. 3 and 4.

The napkin adhesive 14 and accompanying protective cover 15 could functionally be located anywhere on the napkin 20. Most conveniently the napkin adhesive 14 is positioned on one of the bag's faces 11 near the periphery of the napkin 20, as shown in FIG. 5. The napkin adhesive 14 and bag adhesive strips 21 are all pressure sensitive non-drying adhesive. Adhesive of this type, disclosed in U.S. Pat. No. 3,691,140 incorporated by reference herein, permits repeated removal and rebonding without tearing the bag 10 or the napkin 20, so long as the adhesive remains clean and debris free.

Figure 6:
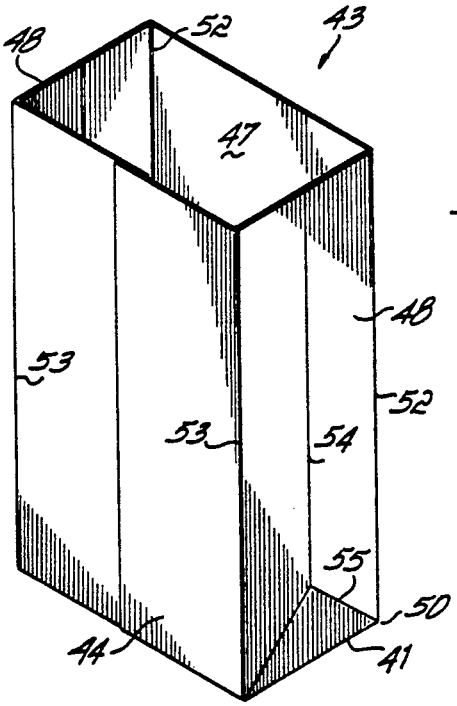
FIG. 6 is a perspective view of a second embodiment of a bag according to the present invention.
Figure 7:
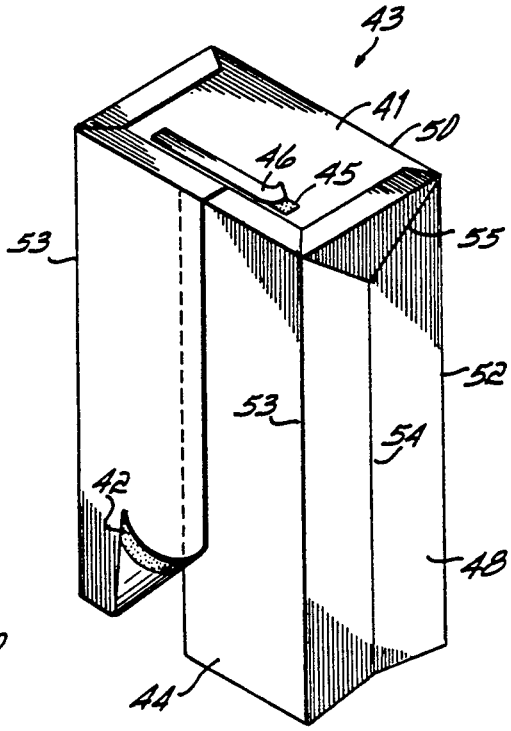
FIG. 7 is a perspective view of the bag of FIG. 6 but with the bag turned upside down or otherwise expressed, with the open top of the bag opening downwardly.
Figure 8:
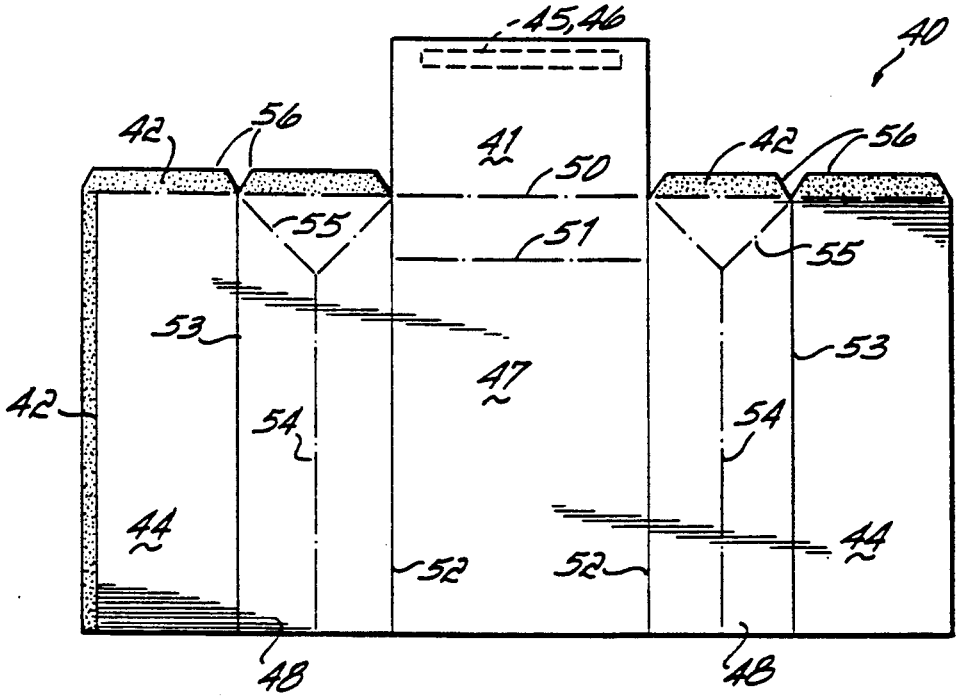
FIG. 8 is a plan view of the bag of FIG. 6 in an unfolded configuration illustrating the fold lines of the second embodiment.

A second embodiment of the present invention is shown in FIGS. 6–8. In this embodiment, the napkin 40 is generally rectangular with a second smaller rectangle, the bag's bottom 41, centered along its length, as shown in FIG. 8. The bag adhesive 42 extends along one shorter edge of the rectangular napkin 40 and along the one lengthwise edge excluding the bag's bottom 41.

The bag 43 according to this embodiment is shown in FIG. 6. The bag 43 is convened into the napkin 40 by detaching the bag adhesive 42 along the center of a split face 44 of the bag 43 and around three of the four edges of the bag's bottom 41. The napkin 40 can then be formed by merely extending the bottom 41 to be planar with the remainder of the napkin 40. Once again, the napkin adhesive 45 and accompanying protective cover 46 could functionally be located anywhere on the napkin, but most conveniently along the bottom's external lengthwise edge as shown in FIG. 8.

The fold pattern of this embodiment can also be seen in FIG. 8. A bottom fold 50 separates the bottom 41 from a face 47 of the bag 43. The bottom flap fold 51 is parallel to the bottom fold 50 and extends between a pair of face folds 52. A pair of side folds 53 extends the width of the napkin 40 and are parallel to the face folds 52. Each side fold 53 and the associated face fold 52 bound the edges of each side 48 of the bag 43. Bisecting each side 48 is a pleat 54 which has a triangular pleat 55 near one edge of the napkin 40. The pleat 54, triangular pleat 55, and bottom flap folds 51 all cooperate enabling the empty bag 43 to be collapsed flat when not in use.

Two pairs of trapezoid shaped tabs 56 are along the lengthwise edge of the napkin 40 and are separated by the bottom 41. Each tab 56 has pressure sensitive non-drying adhesive for attachment to the bottom 41 to form the bag configuration. The adhesive used for the napkin adhesive 45 and on the tabs 46 in this second embodiment of the present invention would be the same type used in the first embodiment previously described and shown in FIGS. 1–5.

From the above disclosure of the general principles of the present invention and the preceding detailed description of preferred embodiments, those skilled in the art will readily comprehend the various modifications to which the present invention is susceptible. Therefore, I desire to be limited only by the scope of the following claims and equivalents thereof.

I claim:

1. A bag convertible to a flat napkin, said bag being formed from a planar sheet by manipulating a plurality of folds in said sheet, said bag having a bottom, opposing first and second sides, opposing first and second faces, and each said face contiguous to said bottom and adjoining said sides; and said plurality of folds including a pair of face folds equally spaced from and parallel to a first centerline of said sheet, said face folds defining edges of said first and second face and said bottom, a pair of side folds equally spaced from and parallel to a second centerline of said sheet, said side folds being perpendicular to said face folds and defining edges of said first and second side and said bottom, four flap folds each extending from and intersection of said side and said face folds to the periphery of said sheet, a pleat fold bisecting each said side and parallel to said side folds, said plurality of folds further including at least one bottom flap fold disposed on a face and extending solely between and perpendicular to said face folds, said bottom flap fold, pleat folds and said side folds permitting said bag to lay flat in an unopened configuration, and a tuck fold extending from each said flap fold to the periphery of said sheet permitting said sheet to be neatly folded into said bag configuration.

2. The bag according to claim 1 further comprising:

fastening means for temporarily attaching said bag when unfolded to a person's clothing for use as a flat napkin while eating.

3. The bag according to claim 2 further comprising:

fixing means for detach ably securing said sheet in said bag configuration.

4. The bag according to claim 3 wherein said fastening and said fixing means each comprise a pressure sensitive non-drying adhesive.

5. The bag according to claim 1 wherein said sheet is generally circular.

6. The bag according to claim 1 wherein said sheet is made of paper.

7. The bag according to claim 1 wherein said bag is open at an end opposing said bottom.

8. A bag convertible to a flat napkin, said bag being formed from a generally circular planar sheet made of paper by manipulating a plurality of folds in said sheet, said bag having a bottom, opposing first and second sides, opposing first and second faces, each said face contiguous to said bottom and adjoining said sides, and said bag being open at an end opposing said bottom;

fastening means for temporarily attaching said bag when unfolded to a person's clothing for use as a flat napkin while eating, said fastening means positioned substantially at the center and top of at least one said face;

fixing means for detachably securing said sheet in said bag configuration, said fixing means located longitudinally along an outer edge of each said side;

said fixing and said fastening means comprise a pressure sensitive non-drying adhesive; and said plurality of folds including a pair of face folds equally spaced from and parallel to a first centerline of said sheet, said face folds defining edges of said first and second face and said bottom, a pair of side folds equally spaced from and parallel to a second centerline of said sheet, said side folds being perpendicular to said face folds and defining edges of said first and second side and said bottom, four flap folds each extending from an intersection of said side and said face folds to the periphery of said sheet, a pleat fold bisecting each said side and parallel to said side folds, said plurality of folds further including at least one bottom flap fold disposed on a face and extending solely between and perpendicular to said face folds, said bottom flap fold, pleat folds and said side folds permitting said bag to lay flat in an unopened configuration, and a tuck fold extending from each said flap fold to the periphery of said sheet permitting said sheet to be neatly folded into said bag configuration.

9. A bag convertible to a flat napkin, said bag being formed from a planar sheet by manipulating a plurality of folds in said sheet, said bag having a bottom, opposing first and second sides, opposing first and second faces, and each said face contiguous to said bottom and adjoining said sides; and said plurality of folds including a pair of face folds equally spaced from and parallel to a first centerline of said sheet, said face folds defining edges of said first and second face and said bottom, a pair of side folds equally spaced from and parallel to a second centerline of said sheet, said side folds being perpendicular to said face folds and defining edges of said first and second side and said bottom, four flap folds each originating at an intersection of said side and said face folds and extending to the periphery of said sheet, a pleat fold bisecting each said side and parallel to said side folds, and said plurality of folds further including at least one bottom flap fold disposed on a face and extending solely between and perpendicular to said face folds, said bottom flap fold, pleat folds and said side folds permitting said bag to lay flat in an unopened configuration.

10. The bag according to claim 9 further comprising:

fastening means for temporarily attaching said bag when unfolded to a person's clothing for use as a flat napkin while eating.

11. The bag according to claim 10 further comprising:

fixing means for detachably securing said sheet in said bag configuration.

12. The bag according to claim 11 wherein said fastening and said fixing means each comprise a pressure sensitive non-drying adhesive.

13. The bag according to claim 9 wherein said sheet is generally circular.

14. The bag according to claim 9 wherein said sheet is made of paper.

15. The bag according to claim 9 wherein said bag is open at an end opposing said bottom.

16. A bag convertible to a flat napkin, said bag being formed from a generally circular planar sheet made of paper by manipulating a plurality of folds in said sheet, said bag having a bottom, opposing first and second sides, opposing first and second faces, each said face contiguous to said bottom and adjoining said sides, and said bag being open at an end opposing said bottom;

fastening means for temporarily attaching said bag when unfolded to a person's clothing for use as a flat napkin while eating, said fastening means positioned substantially at the center and top of at least one said face;

fixing means for detachably securing said sheet in said bag configuration, said fixing means located longitudinally along an outer edge of each said side;

said fixing and said fastening means comprise a pressure sensitive non-drying adhesive; and said plurality of folds including a pair of face folds equally spaced from and parallel to a first centerline of said sheet, said face folds defining edges of said first and second face and said bottom, a pair of side folds equally spaced from and parallel to a second centerline of said sheet, said side folds being perpendicular to said face folds and defining edges of said first and second side and said bottom, four flap folds each originating at an intersection of said side and said face folds and extending to the periphery of said sheet, a pleat fold bisecting each said side and parallel to said side folds, and said plurality of folds further including at least one bottom flap fold disposed on a face and extending solely between and perpendicular to said face folds, said bottom flap fold, pleat folds and said side folds permitting said bag to lay flat in an unopened configuration.

* * * * *